US008031882B2

(12) United States Patent
Ding

(10) Patent No.: US 8,031,882 B2
(45) Date of Patent: Oct. 4, 2011

(54) METHOD AND APPARATUS TO REDUCE THE EFFECT OF FLUX MODULATION IN SPEAKERS

(76) Inventor: Chih-Shun Ding, Austin, TX (US)

( * ) Notice: Subject to any disclaimer, the term of this patent is extended or adjusted under 35 U.S.C. 154(b) by 869 days.

(21) Appl. No.: 12/050,909

(22) Filed: Mar. 18, 2008

(65) Prior Publication Data

US 2009/0067643 A1 Mar. 12, 2009

Related U.S. Application Data

(60) Provisional application No. 60/970,465, filed on Sep. 6, 2007.

(51) Int. Cl.
*H04R 3/00* (2006.01)

(52) U.S. Cl. ..... 381/96

(58) Field of Classification Search ..... 381/59, 381/96, 92–94, 120, 97
See application file for complete search history.

(56) References Cited

U.S. PATENT DOCUMENTS 5,537,479 A * 7/1996 Kreisel et al. ..... 381/96
5,764,781 A * 6/1998 Ding ..... 381/96
2001/0003541 A1* 6/2001 Koyano et al. ..... 381/111
2003/0194097 A1* 10/2003 Ding ..... 381/96
2004/0047477 A1* 3/2004 Bank et al. ..... 381/120
2004/0052358 A1* 3/2004 Lashley et al. ..... 379/387.01
2005/0084117 A1* 4/2005 Miyashita et al. ..... 381/97
2005/0134374 A1* 6/2005 Hench et al. ..... 330/86
2006/0084396 A1* 4/2006 Matthew et al. ..... 455/107
2006/0132231 A1* 6/2006 Ishii et al. ..... 330/10
2011/0032039 A1* 2/2011 Jones et al. ..... 330/297

* cited by examiner

*Primary Examiner* — Nathan Ha
(74) *Attorney, Agent, or Firm* — Oppedahl Patent; Law Firm LLC

(57) ABSTRACT

A speaker feedback system has a linear current feedback derived from a current sensing resistor. A linear motional feedback from the active speaker driver is derived from a sensing coil mechanically coupled with the driver coil of the speaker, the driver coil receiving electrical energy from the power amplifier. A motional signal correction circuit extracts the motional signal from the sensing coil and feeds to input B of the multiplier. A current filter circuit filters out higher-frequency signals from the current feedback signal and then feeds to input A of the multiplier. A multiplier performs the multiplication function of its two inputs and produces an output. Post-multiplier equalization circuitry that control the feedback gain of the nonlinear feedback system such that it can effectively compensate for the effect of flux modulation over the targeted frequency range. A feedback network feeds the output from post multiplier equalization to the power amplifier.

10 Claims, 6 Drawing Sheets

METHOD AND APPARATUS TO REDUCE THE EFFECT OF FLUX MODULATION IN SPEAKERS

CROSS-REFERENCE TO RELATED APPLICATIONS

This application claims the benefit of U.S. application Ser. No. 60/970,465 filed Sep. 6, 2007.

BACKGROUND

1. Field of Invention

The present application is related generally to the field of high-fidelity speaker systems where motional feedback signal is used to enhance the performance.

2. Prior Art (Magnetic) Flux modulation is a modulation of magnetic flux passing through the air gap of the motor structure as a function of applied current. Such modulation is undesirable in that it can cause distortion in the sound reproduced from the speakers. The cause of flux modulation can be explained with reference to FIG. 1, a typical motor structure. In FIG. 1, 1 is the pole piece; 2 is the magnet; 3 is the top plate; 4 is the voice coil; 5 is the back plate; and the space between 1 and 3 is called the air gap, which is also where voice coil 4 resides. The dashed line indicates the magnetic flux direction in the motor structure. The drawn arrow direction is arbitrary as it depends on the polarity of 2. The voice coil also acts as an inductor. That means when a current passes through it, it generates magnetic flux in the pole piece just as an inductor will do. On the other hand, the motor structure is designed to facilitate the passing of magnetic flux through the air gap. Therefore it is designed such that the dashed line loop is the least effort return path for the magnetic flux. Because of this reason, the magnetic flux generated by a current can follow the dashed line loop to complete the least effort return path. And this additional magnetic flux causes the modulation of the magnetic flux.

Flux modulation is getting worse in recent years because high power amplifiers and speakers (>1 kW) are becoming popular. Higher power means higher current and therefore higher flux modulation. And this problem not only affect the drivers used to low frequency (as often referred to as sub-woofer), it also affect the drivers used at the higher frequency. In the past, short circuit rings have been placed around the pole piece to reduce the effect of flux modulation, such as one described in paper "Moving-coil Loudspeaker Topology as an Indicator of Linear Excursion Capability" by Mark R. Gander in Journal of AES Vol 29 No 1/2 1981 January/February, pp 10-26. The issue with short circuit rings is the physical size of the ring may have to be huge in order to be effective, and that increases the cost. And smaller rings are not effective at reducing flux modulation at low frequency. Other similar techniques include U.S. Pat. Nos. 5,815,587 and 5,151,943.

All of the above-mentioned techniques address the flux modulation from a magnetic circuit's operating point of view. The present invention addresses this issue using a nonlinear feedback system with the feedback signal as a nonlinear function of two components: 1) current through the driver voice coil (the main voice coil that converts the electrical energy to mechanical energy), and 2) the motional feedback signal which is derived from a sensing coil wound on the same former as the main voice coil, which is also referred to as the driver coil. In other words, the present invention is completely orthogonal with the usage of short-circuit rings and can be applied at the same time.

Other patents of possible interest include U.S. Pat. No. 5,764,781 issued Jun. 9, 1998, U.S. Pat. No. 6,104,817 issued Aug. 15, 2000, and U.S. Pat. No. 7,215,590 issued May 8, 2007.

Nonlinear feedback systems have been proposed in the past to linearize the BL profile over a large travel distance of the voice coil. One technique is U.S. Pat. No. 5,542,001, which taught a method of linearizing the back-emf motional signal by introducing a multiplier, integrator, and correction generator in an inner feedback loop within the motional feedback path. That is, there is a local feedback loop inside the global feedback loop.

Yet, another technique was proposed when A. J. M. Kaizer examined the issue of correcting the nonlinearity of electrodynamic loudspeakers; and the result was published in the paper "Modeling of the Nonlinear Response of an Electrodynamic Loudspeaker by a Volterra Series Expansion", appeared in Journal of Audio Engineer Society, vol. 35, no 6, 1987 June, page 421-433. The paper proposed a voltage drive and a current drive $2_{nd}$ order distortion reduction circuits. However, both circuits operate on a feedforward principle instead of a feedback principle and A. J. M. Kaizer subsequently obtained U.S. Pat. No. 4,709,391. The main difference between a feedforward system and a feedback system is that the former needs a forward prediction of how the system will perform and generates a forward correction term based on the prediction to achieve a lower distortion. As a result, the unit-to-unit variation and change of operation condition can render the techniques less effective.

The objectives of the above-mentioned non-linear feedback techniques were to linearize the BL profile and therefore they are insufficient in addressing the issue of flux modulation.

SUMMARY OF THE INVENTION

It is desirable to provide nonlinear motional feedback to reduce the distortion by injecting a distortion compensation signal into the system. FIG. 2 shows an example of a conventional linear motional feedback speaker system that uses a combination of motional feedback 13 and current feedback 15. The motional signal is derived from a sensing coil 17 that is mechanically coupled to the driver coil 16, which is driven by a power amplifier system 14. The current signal can be derived from a current sensing resistor 11 in series with the driver coil. The characteristic of this type of system is that the output is a strong function of the signal from the sensing coil. Therefore keeping the motional signal isolated from the influence of flux modulation is the key to maintain low distortion in the output. However, with a linear feedback arrangement, this objective is difficult to achieve as explained next. For the simplicity of demonstration, I first assume there is no mutual inductance between the driver and sensing coils. Later, this assumption will be removed. First, let Vs denote the output from the sensing coil, Bs denote the average flux density in the air gap of the speaker with respect to sensing coil, l (lower case l) denotes the wire length of the sensing coil, and v denote the velocity of the voice coil. Vs can be written as:

$$Vs=B_s lv \quad [1]$$

In the presence of flux modulation, Bs is not a constant value. As a result, we can rewrite Bs as a sum of a constant value Bs(0) plus a component, f(I), which is a function of the current through driver coil:

$$Bs=Bs(0)+f(I) \quad [2]$$

where Bs(0) is the Bs value at 0 current, and I is the current through the driver coil, and f(I) is a function of I. Note in Equation [2] the current in the sensing coil is omitted for the sake of simplicity. If the current in the sensing coil is significant enough, we can include such effect in f(I).

Equation [1] can be rewritten as:

$$Vs=B_s(0)lv+f(I)lv \quad [3]$$

The second term on the right-hand side is the distortion term. From Equation [3], it can be seen that if one would like to maintain non-distorted velocity v in the presence of current, the motional signal needs to contain the distortion term. It is therefore desirable to generate the non-linear component in the motional signal, f(I)Lv, such that we get non-distorted velocity. However, the derivation of this term faces several issues in practice. The first issue is derivation of velocity signal v from the sensing signal due to the mutual inductance between driver coil and sensing coil. The second issue is that the function f(I) is frequency-dependent due to the eddy current in the pole piece and the Faraday current through the short-circuit ring when it is present. The third issue is the design of feedback loop gain such that distortion compensation is effective over a wide frequency range. Therefore it is also desirable if the non-linear feedback system can effectively reduce the effect of flux modulation on the motional sensing signal over a portion, or even the entirety of the frequency range in which the system is intended to operate.

DESCRIPTION OF THE PREFERRED EMBODIMENT

Figure 3:
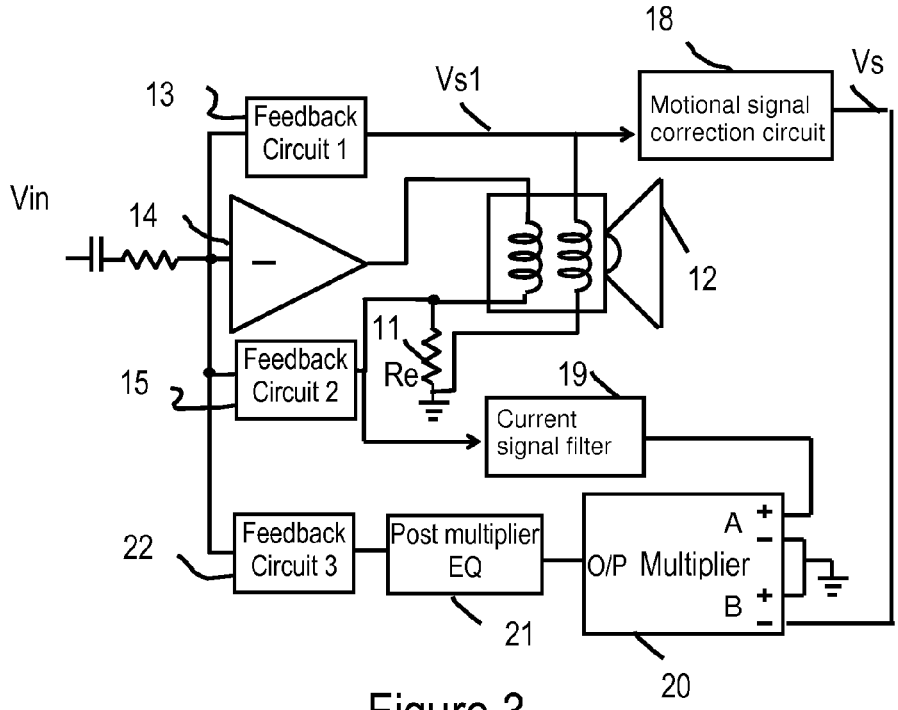
FIG. 3 is the preferred embodiment of present invention.

FIG. 3 shows the preferred embodiment of the present invention with the following components:

1. a linear current feedback derived from current sensing resistor 11;
2. a linear motional feedback 13 from the active speaker driver is derived from a sensing coil mechanically coupled with the driver coil of the speaker, the driver coil receiving electrical energy from the power amplifier;
3. a motional signal correction circuit 18 that extracts the motional signal from the sensing coil and feeds to input B of the multiplier;
4. a current filter circuit 19 that filters out higher-frequency signals from the current feedback signal and then feeds to input A of the multiplier;
5. a multiplier that performs the multiplication function of its two inputs and produces an output;
6. post-multiplier equalization circuitry 21 that control the feedback gain of the nonlinear feedback system such that it can effectively compensate for the effect of flux modulation over the targeted frequency range;
7. a feedback network that feeds the output from post multiplier EQ 21 to the power amplifier 14;
8. Vin is the system input.

Figure 1:
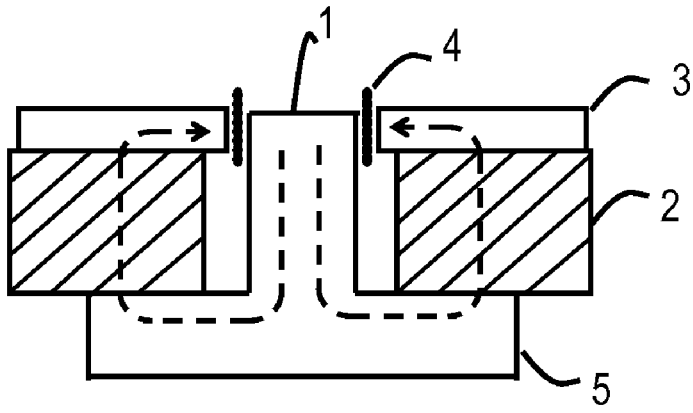
Figure 1 PRIOR ART
FIG. 1 is a prior art motor structure.
Figure 2:
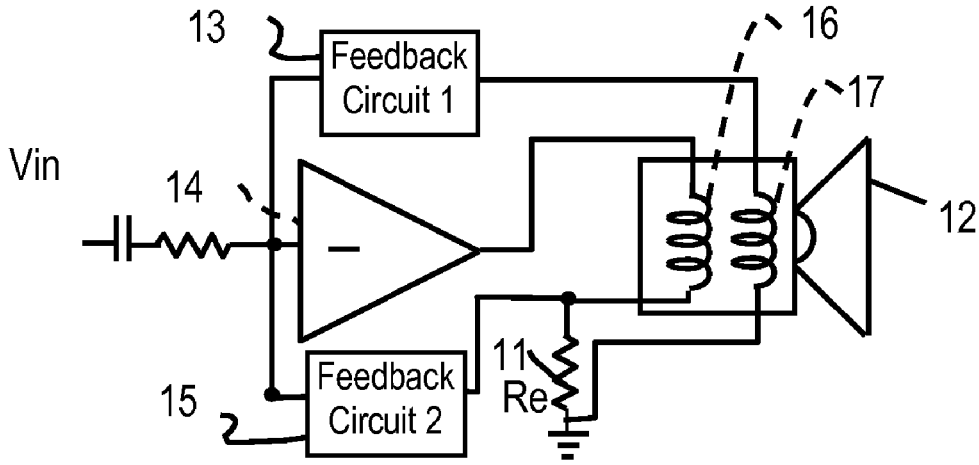
Figure 2 PRIOR ART
FIG. 2 is a prior art motional feedback system that uses both motional and current.

Essentially, the power amplifier receives two linear feedbacks and one non-linear feedback. In contrast, the prior-art implementation will only have two linear feedbacks as shown in FIG. 2. In addition, in practice, components 21 and 22 can be combined into a single unit. Here, they are drawn separately for sake of explanation.

The purpose of the motional signal correction circuit 18 is to filter out the mutual inductance component of the signal from the sensing coil used in FIGS. 2 and 3. To facilitate the explanation, the term motional signal refers to the signal directly from the sensing coil in general (shown as Vs1 in FIG. 3). The term true motional signal (shown as Vs in FIG. 3) refers to the component in a motional signal that is directly related to the movement of th voice coil. If a motional signal does not have a mutual inductance component, the motional signal is the same as the true motional signal and the motional signal correction circuit is not needed. In this case, the correction circuit is just a wire between its input and output.

Figure 7:
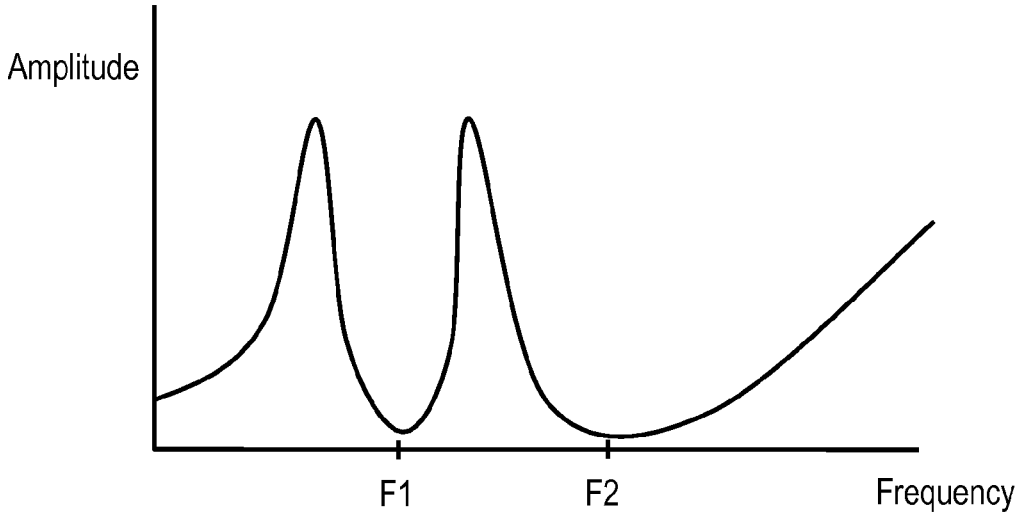
FIG. 7 is the frequency characteristic of the motional impedance plus mutual inductance between sensing and driver coils.

The frequency characteristic of the motional signal correction circuit depends on the driver's parameters and can be approximated via the following steps. First, plot the motional signal versus the current that flows through the speaker. That is Vs1/I, where I is the current through 11 (or Re). This plot is referred to as the motional impedance plot. FIG. 7 shows one example for vented-box speakers. Frequency F1 is the box tuning frequency. A typical value is 20 hz. It is also one of the minimal impedance points. The rising trend at higher frequency is due to mutual inductance between sensing and driver coils. Strictly speaking, the motional impedance should have been defined with respect to the driver coil, instead of the sensing coil, because the number of turns in these two coils can be different. When the numbers of turns is the same, the motional impedance will be almost the same for both sensing and driver coils with only slight deviation. When the numbers of turns is different, one is roughly just a scale-up or scale-down version of the other with slight deviation. Without loss of generality, we assume for sake of discussion that they are the same. The derivation results can be easily adapted to the general case by applying a scaling factor.

Figure 4:
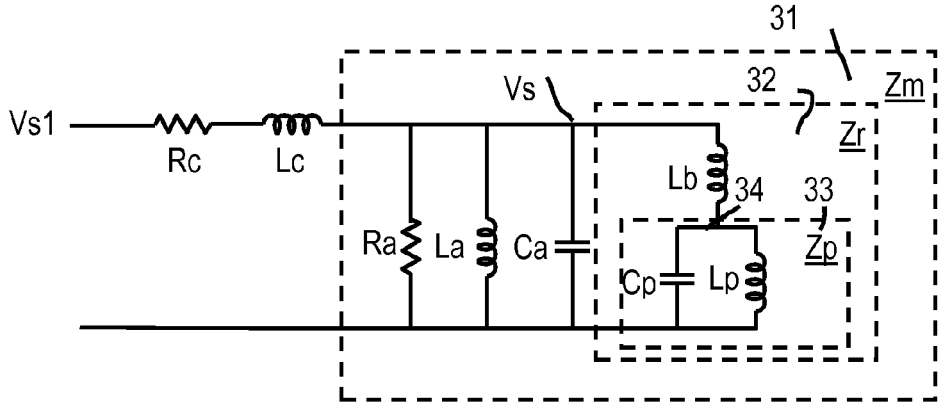
FIG. 4 is the equivalent motional impedance plus the mutual inductance between sensing and driver coil in relation to a vented box speaker.
Figure 5:
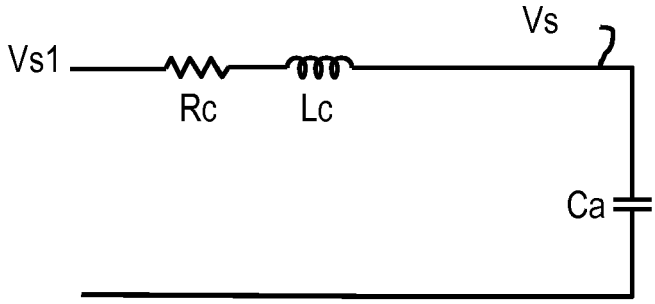
FIG. 5 is simplified motional impedance of FIG. 4 at higher frequency.

The equivalent circuit of motional impedance is well known. For example, the equivalent circuit of the motional impedance in FIG. 7 is shown in FIG. 4. Note that this is for a vented-box speaker. For a sealed-box speaker, the network of Lb and Cp will be absent. To derive the true motional signal Vs from a motional signal Vs1 is equivalent to finding the impedance divider ratio of Cp in the entire network. The impact of Lc is significant at higher frequency. So the network can be approximated as in FIG. 5. As a result, the motional signal correction circuit should implement a function that is related to:

$$F1(s) = \frac{1/CaS}{1/CaS + Rc + LcS} = \frac{1}{1 + RcCas + LcCas^2} \quad [7]$$

Figure 6:
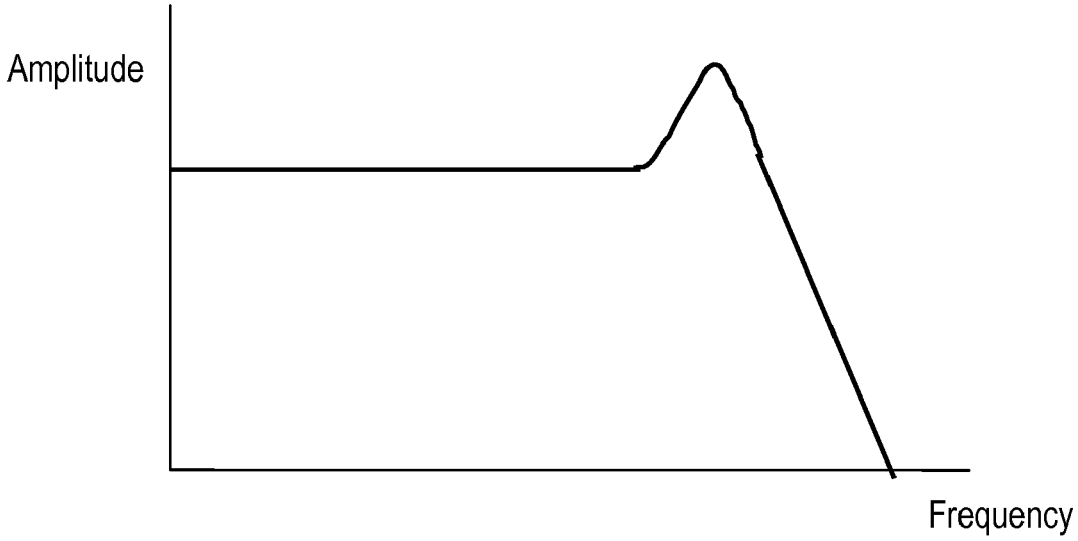
FIG. 6 is frequency characteristic of the motional signal correction circuit.

The function is essential a $2_{nd}$-order low pass filter with very high Q value, as shown in FIG. 6. Please note Rc is not voice-coil resistance, instead it is the minimal value at point F2 in FIG. 7. The typical value of F2 for a driver used in subwoofer application is 60-100 hz. Rc is used in this description to categorically represent the deviation between real world measurement and a highly theoretical model (such as one in FIG. 4, except Rc is zero). Therefore it may not have a physical meaning. Theoretically, Rc should be very close to zero. However, in reality, Rc is some finite (nonzero) value. The fact that Rc is nonzero can affect the accuracy of deriving a true motional signal in speaker configuration such as vented a box or passive radiator at resonance frequency (or tuning frequency) where the cone movement of the driver can suddenly drop to a very low level. In this case, one can modify the motional signal correction circuit to improve the compensation results, as explained below.

The reason for the current filter is that the flux modulation is frequency dependent. At higher frequency, the effect is less significant. This is primarily because the eddy current in the pole piece can reduce flux modulation. A short-circuit ring around the pole piece also has similar effect, except the reduction of flux modulation is more significant. A second-order lowpass filter with Q<1 is found to be effective for this current filter. In the case of a 12" driver with a shortcircuit ring, it is found that the corner frequency is around 60 Hz. However, this should not be interpreted as a limitation in the scope of the present invention. For those who are skilled in the art that use a different driver, one can use a different corner frequency and Q value to achieve similar results. And the order of the attenuation can range from a $1_{st}$-order characteristic to higher-order characteristic.

The multiplier performs the function of multiplying a current signal with a true motional signal because through an actual implementation of the current invention, it was found the first-order approximation of f(I)=kI, where k is a constant, is good at lower frequencies. At higher frequencies, a function of the current filter is used to provide a better approximation. In addition, the polarity of the feedback from an actual present-day implementation also indicates the nonlinear feedback is a positive feedback. That is the reason the polarity of the motional signal going into input B of the multiplier is reversed. This indicates the sign of the constant k in the first-order approximation of f(I) is positive. In the case when k is negative, we need to change the positive feedback to negative feedback on the non-linear feedback. Also the nature of positive feedback prompts us to prefer under-correction to over-correction. Note that in FIG. 3, the polarity of input B of the multiplier is reversed in order to implement a positive nonlinear feedback for the case when k is positive. The purpose of the post-multiplier EQ is explained next.

Figure 10:
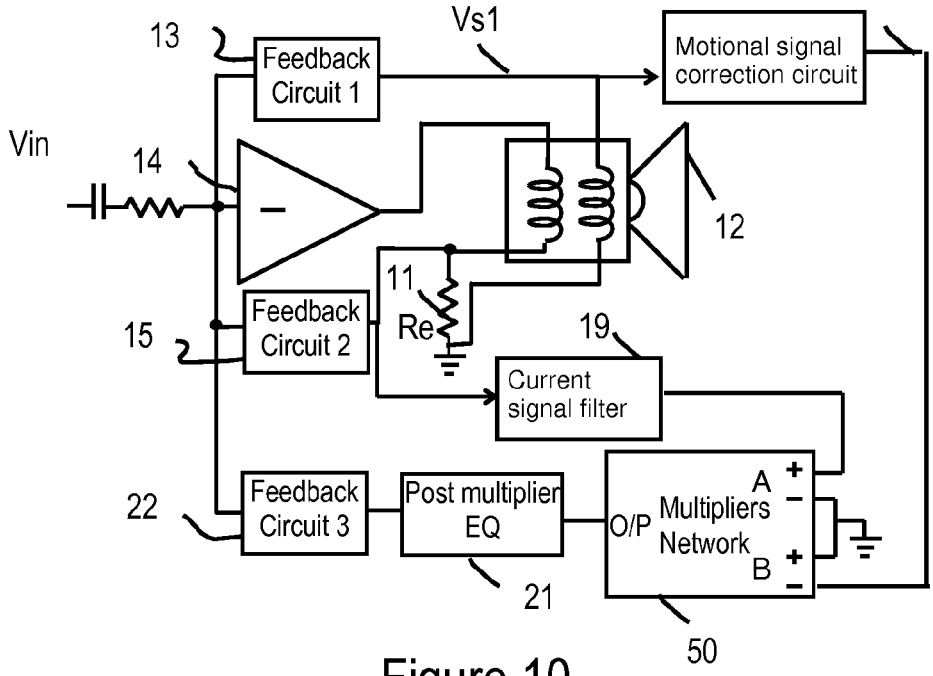
FIG. 10 shows a plot for loop gain of the non-linear feedback for speakers such as sealed box speakers.

The first purpose of the post-multiplier filter is to provide a relatively flat (linear feedback) loop gain, such as one shown in FIG. 10, from the output of the multiplier 20 to the true motional signal Vs so that the compensation will be effective. Deviation from FIG. 10 is possible as long as the degradation of distortion compensation is still acceptable. The post-multiplier filter can also serve to filter out the non-linear feedback signals that are outside the operating frequency range of the speaker. Occasionally, when the exact f(I) function is too complicated to implement correctly over a wide frequency range, it is likely the signals at the multiplier output can actually introduce additional distortions, instead of canceling the distortions. As a result, the third purpose of the post-multiplier filter is to attenuate signals from the multiplier output that could otherwise cause additional distortion. Alternatively, one can also use this filter to enhance distortion reduction at certain frequency ranges. Those skilled in the art would appreciate that certain tradeoffs on the loop gain characteristic need to made to achieve an overall effective distortion reduction.

Figure 8:
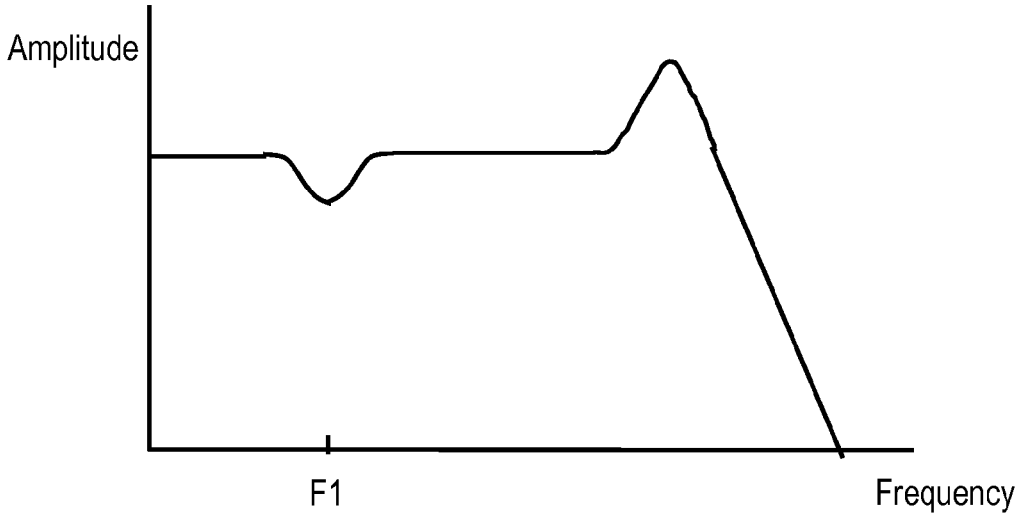
FIG. 8 shows a notch characteristic added to FIG. 6 intended to use with speakers such as vented box speakers.
Figure 9:
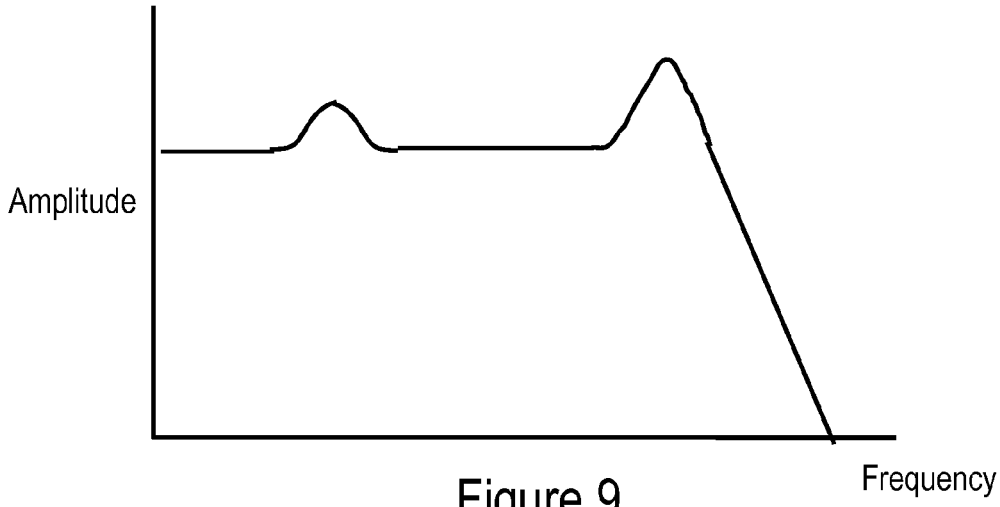
FIG. 9 shows a hump characteristic added to FIG. 6 intended to use with speakers such as vented box speakers.
Figure 11:
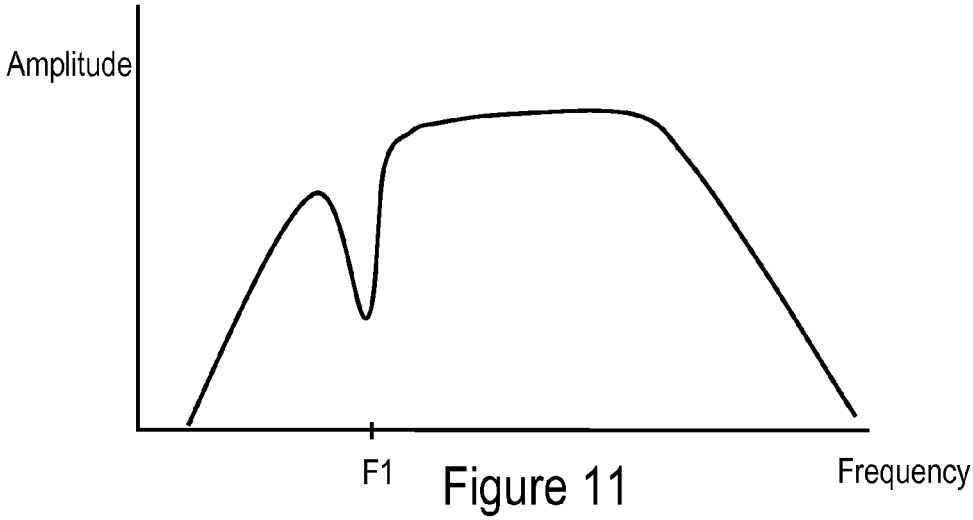
FIG. 11 shows a plot for loop gain of the non-linear feedback for speakers such as vented box speakers.
Figure 12:
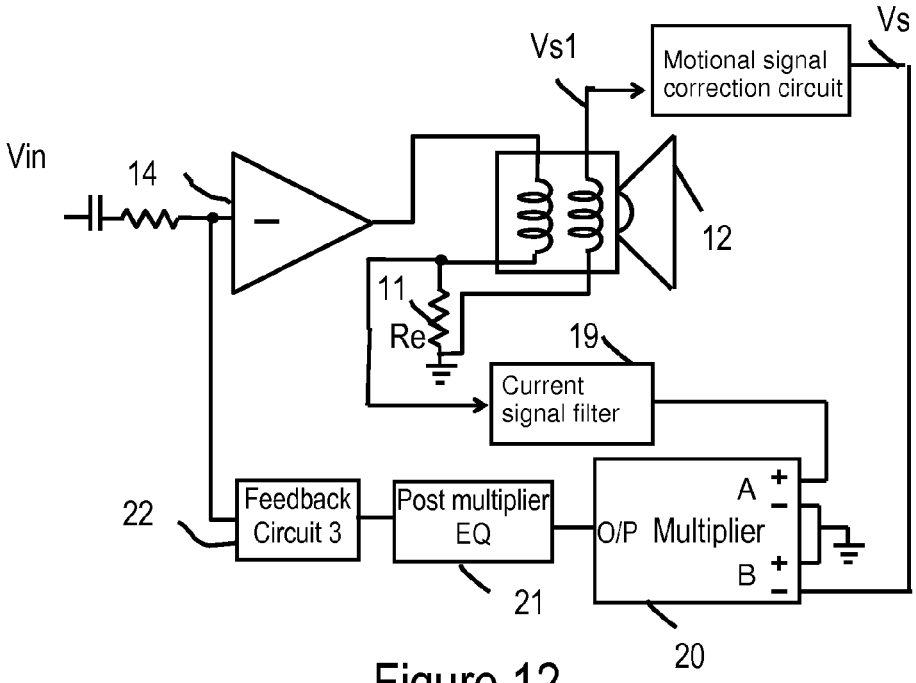
FIG. 12 shows an embodiment for a nonservo based speaker system.

For sealed-box speakers the above arrangement is very effective. The main reason is the true motional signal is by and large high enough so the approximation in Equation [1]-[3] is sound. For speaker configurations such as vented box, the cone movement can suddenly drop to almost zero at the box tuning frequency. At the frequency where the cone movement is very small, the accuracy of using motional signal from sensing coil to approximate real world cone velocity can be gross enough that the nonlinear feedback causes additional unwanted distortion, instead of canceling the distortion. In this case, it is necessary to modify the motional signal correction circuit to attenuate the motional signal around F1 such as one shown in FIG. 8. On rare occasions, better results may be achieved using a hump characteristic instead of notch as the one shown in FIG. 9. Other speaker configurations with this local minimal cone movement characteristic include transmission-line speakers and bandpass speakers. FIG. 11 also shows a typical loop gain of the nonlinear feedback for vented box speakers. The notch characteristic around F1 may make the distortion compensation less effective around F1. However, this is acceptable because its impact is less distortion compensation, instead of introducing more distortion at the frequency range around F1. Alternatively, a bump characteristic around F1 can be implemented in the post multiplier EQ block to achieve a flatter loop gain characteristic. The above scheme can also be applied to conventional non-servo feedback systems, such as the one shown in FIG. 12.

The present invention can also be used to partially compensate for other types of distortion such as spider nonlinearity, in addition to addressing the distortion caused by flux modulation. This is mainly because the final evaluation of distortion reduction requires real-world distortion measurements. It is possible to separate the distortion components attributable to flux modulation from those attributable to other factors because the contribution of flux modulation is minimal when the impedance is high. By varying the location of the impedance peak using either additional mass attached to speaker cone, or enclosures of various sizes, one can easily measure the distortion attributable to flux modulation and from other sources. While it is possible to do so, what is desired is to achieve an overall lower distortion. In other words, in the context of a more complicated distortion compensation feedback system that addresses multiple distortion sources, the present invention can be implemented as a component of such a system. One such an example has the multiplier block replaced with a multiplier network that generates multiple higher order nonlinear terms in addition to the simple nonlinear term A times B shown in block 20 of FIG. 3. Moreover, while this disclosure has been discussed mainly on the analog domain, for those skilled in the art of digital signal processing would appreciate that the present invention can also be implemented in th digital domain using the techniques of digital signal processing.

Finally, those person skilled in the art would appreciate that the embodiments disclosed herein are merely to illustrate several of many forms which the invention may take in practice and numerous modifications can be made without departing from the present invention, to achieve various levels of distortion reduction.

The invention claimed is:

1. A sound reproduction system comprising an amplifier system, a speaker, first and second negative feedback means, and a third feedback means;

the speaker having a diaphragm, a first voice coil mechanically coupled with the diaphragm, and motional measurement means having an output;

the amplifier system comprising an amplifier with an input and an output, the amplifier output electrically coupled to the first voice coil;

the first feedback means comprising first circuitry coupling the motional measurement means output with the amplifier input; and the second feedback means comprising a current measurement means electrically coupled with the first voice coil and having an output, the output coupled with the amplifier input;

the third feedback means comprising a multiplier with first and second inputs and having an output;

the third feedback means further comprising a motional signal correction means extracting a motional signal from the motional measurement means, and feeding a signal indicative thereof to the first input of the multiplier;

the third feedback means further comprising a motional current filter means filtering out high-frequency signals from the current measurement means, and feeding a signal indicative thereof to the second input of the multiplier;

the third feedback means further comprising equalization circuitry receiving the output of the multiplier and feeding a feedback signal to the amplifier.

2. The system of claim 1 wherein the speaker has a pole piece, the speaker further comprising a short-circuit ring around the pole piece.

3. The system of claim 1 wherein the speaker further comprises a coil formed upon which the first voice coil is wound, and further comprises a second voice coil wound on the coil form, and wherein the first and second voice coils are disposed within a permanent magnetic field, the second voice coil comprising the motional measurement means.

4. The system of claim 1 wherein the current measurement means comprises a resistor disposed electrically in series with the first voice coil, the voltage drop across the resistor comprising the output of the current measurement means.

5. A method of sound reproduction comprising:

electrically coupling an amplifier system with a speaker, whereby the amplifier drives the speaker, the speaker having a diaphragm and a first voice coil mechanically coupled thereto;

providing a first negative feedback to the amplifier indicative of changes in the position of the diaphragm;

providing a second negative feedback to the amplifier indicative of the current through the first voice coil, developing a motion correction signal indicative of motion of the diaphragm;

developing a low-passed signal derived from the current through the first voice coil;

multiplying the motion correction signal and the developed low-passed signal, and providing a third feedback to the amplifier indicative of the product.

6. The method of claim 5 wherein the step of providing the first feedback further comprises providing a second voice coil mechanically coupled to the diaphragm, voltage induced in the second voice coil being indicative of changes in the position of the diaphragm.

7. A sound reproduction system comprising an amplifier system, a speaker, and a first feedback means;

the speaker having a diaphragm, a first voice coil mechanically coupled with the diaphragm, and motional measurement means having an output;

the amplifier system comprising an amplifier with an input and an output, the amplifier output electrically coupled to the first voice coil;

the first feedback means comprising a multiplier with first and second inputs and having an output;

the third feedback means further comprising a motional signal correction means extracting a motional signal from the motional measurement means, and feeding a signal indicative thereof to the first input of the multiplier;

the third feedback means further comprising a motional current filter means filtering out high-frequency signals from the current measurement means, and feeding a signal indicative thereof to the second input of the multiplier;

the third feedback means further comprising equalization circuitry receiving the output of the multiplier and feeding a feedback signal to the amplifier.

8. The system of claim 7 wherein the speaker has a pole piece, the speaker further comprising a short-circuit ring around the pole piece.

9. The system of claim 7 wherein the speaker further comprises a coil form upon which the first voice coil is wound, and further comprises a second voice coil wound on the coil form, and wherein the first and second voice coils are disposed within a permanent magnetic field, the second voice coil comprising the motional measurement means.

10. The system of claim 7 wherein the current measurement means comprises:

a resistor disposed electrically in series with the first voice coil, the voltage drop across the resistor comprising the output of the current measurement means.

* * * * *